US010369084B2

(12) United States Patent
Tesini et al.

(10) Patent No.: US 10,369,084 B2
(45) Date of Patent: Aug. 6, 2019

(54) BIOLOGIC RESPONSE TEETHER

(75) Inventors: David A. Tesini, Hopkinton, MA (US); Joshua Wiesman, Weston, MA (US)

(73) Assignee: TW Innovations, LLC, Hopkinton, MA (US)

( * ) Notice: Subject to any disclaimer, the term of this patent is extended or adjusted under 35 U.S.C. 154(b) by 251 days.

(21) Appl. No.: 13/028,506

(22) Filed: Feb. 16, 2011

(65) Prior Publication Data

US 2011/0160769 A1 Jun. 30, 2011

Related U.S. Application Data

(63) Continuation of application No. PCT/US2009/054125, filed on Aug. 18, 2009.

(60) Provisional application No. 61/089,606, filed on Aug. 18, 2008.

(51) Int. Cl.
*A61J 17/00* (2006.01)
*A61J 17/02* (2006.01)

(52) U.S. Cl.
CPC ..... *A61J 17/02* (2013.01); *A61J 17/008* (2015.05)

(58) Field of Classification Search
CPC .... A61J 17/00; A61J 17/02; A61J 7/00; A61J 11/00; A61J 11/0035; A61J 11/004–0065; A61J 11/007; A61J 13/00; A61J 17/001; A61J 17/008; A61J 17/002–007; A61H 13/00; A63H 33/006
USPC ..... 606/234–235
See application file for complete search history.

(56) References Cited

U.S. PATENT DOCUMENTS

| | | | | | |
|---|---|---|---|---|---|
| 516,561 | A | * | 3/1894 | Bosch | 606/235 |
| 699,757 | A | * | 5/1902 | Howell | 606/236 |
| 2,234,137 | A | * | 3/1941 | Hoover | 446/419 |
| D160,140 | S | * | 9/1950 | Binney | D24/195 |
| D197,889 | S | * | 4/1964 | Hass | D24/194 |
| 3,601,129 | A | * | 8/1971 | Seidl | A61J 17/00 606/236 |
| 4,402,321 | A | * | 9/1983 | Berg | A61J 17/00 606/236 |
| 4,403,613 | A | * | 9/1983 | Panicci | 606/236 |
| D280,749 | S | * | 9/1985 | Thomson et al. | D21/408 |
| 4,569,349 | A | | 2/1986 | McKee | |
| D290,655 | S | * | 6/1987 | Thomson et al. | D24/195 |
| 4,898,171 | A | * | 2/1990 | Moss | A61J 17/00 606/236 |

(Continued)

FOREIGN PATENT DOCUMENTS

| | | | | |
|---|---|---|---|---|
| EP | 0 536 636 A1 | | 4/1993 | |
| FR | 2595046 A1 | * | 9/1987 | A61J 17/00 |

(Continued)

OTHER PUBLICATIONS

International Preliminary Report on Patentability dated Mar. 3, 2011 in corresponding PCT application No. PCT/US2009/054125.

(Continued)

*Primary Examiner* — Tuan V Nguyen
(74) *Attorney, Agent, or Firm* — Brian M. Dingman; Dingman IP Law, PC

(57) ABSTRACT

A biologic-response teether (150). The teether (150) has a shield (160) and one or two generally "T"-shaped bite portions (170, 180) projecting from the shield (160). The bite portions (170, 180) each define an elongated stem (171, 181) closest to the shield (160) and two arms (169, 168) that are coupled to and transverse to the stem (171, 181).

19 Claims, 9 Drawing Sheets

(56) References Cited

U.S. PATENT DOCUMENTS 4,898,291 A * 2/1990 Sailors ..... A61J 9/00 215/11.1
4,986,751 A * 1/1991 Bergersen ..... 433/6
D314,621 S * 2/1991 Bernstein et al. ..... D24/195
5,013,320 A * 5/1991 Orpaz ..... 606/234
5,133,740 A * 7/1992 Kussick ..... A61J 17/00 215/11.1
5,211,656 A * 5/1993 Maddocks ..... A61J 17/00 606/234
D336,520 S * 6/1993 McDaniel ..... D24/194
D339,196 S * 9/1993 Spence, Jr. ..... D24/195
5,259,762 A * 11/1993 Farrell ..... A61C 7/08 433/215
5,334,218 A * 8/1994 Johnson ..... 606/235
5,342,398 A 8/1994 Sun
5,403,349 A * 4/1995 Rohrig ..... A61J 17/00 606/234
D380,269 S * 6/1997 Mendes ..... D24/194
D395,515 S * 6/1998 Fletcher ..... D24/195
D395,516 S * 6/1998 Fletcher ..... D24/195
5,814,074 A * 9/1998 Branam ..... A61J 17/001 606/234
D403,072 S * 12/1998 Rogers Huante ..... D24/194
5,843,128 A * 12/1998 Wexler ..... 606/234
5,993,413 A * 11/1999 Aaltonen et al. ..... 604/77
6,056,774 A * 5/2000 Johansen et al. ..... 606/234
6,063,107 A * 5/2000 Wexler ..... 606/234
6,080,186 A * 6/2000 Pedersen et al. ..... 606/234
D430,300 S * 8/2000 Anthony, Jr. ..... D24/194
D453,401 S * 2/2002 Kaplan ..... D30/160
D457,966 S * 5/2002 Espemar ..... D24/194
6,436,125 B1 * 8/2002 Rhoads ..... A61J 17/00 606/234
D480,147 S * 9/2003 Sanbrook et al. ..... D24/194
6,773,451 B1 * 8/2004 Dussere ..... A61J 17/001 606/235
6,837,037 B2 * 1/2005 Willinger ..... 59/85
7,029,491 B2 * 4/2006 Davis ..... A61J 17/00 606/234
D547,455 S * 7/2007 Greenberg ..... D24/194
7,294,141 B2 * 11/2007 Bergersen ..... 606/236
7,789,894 B2 * 9/2010 Rohrig ..... A61J 17/00 606/234
7,883,530 B2 * 2/2011 Tesini ..... A61J 17/00 606/236
8,057,512 B1 * 11/2011 Gibson ..... 606/235
D685,485 S * 7/2013 Swern et al. ..... D24/194
D695,411 S * 12/2013 Swern et al. ..... D24/194
2002/0077663 A1 * 6/2002 Hinshaw ..... 606/235
2003/0050669 A1 * 3/2003 Branam ..... A61J 17/00 606/234
2003/0163162 A1 * 8/2003 Uehara ..... A61J 17/00 606/234
2003/0176891 A1 * 9/2003 Frederic ..... 606/234
2005/0080456 A1 * 4/2005 Sanbrook et al. ..... 606/235
2006/0036285 A1 * 2/2006 Davis ..... A61J 17/00 606/234
2007/0016253 A1 * 1/2007 Doherty et al. ..... 606/235
2007/0112386 A1 * 5/2007 Branam ..... 606/234
2007/0238063 A1 * 10/2007 Tesini et al. ..... 433/7
2008/0188894 A1 * 8/2008 Hakim ..... 606/236
2009/0018582 A1 * 1/2009 Ishikawa et al. ..... 606/235
2009/0192547 A1 * 7/2009 Gates ..... A61J 17/00 606/235
2010/0063543 A1 * 3/2010 Moses et al. ..... 606/236

FOREIGN PATENT DOCUMENTS

WO WO 8603402 A1 * 6/1986 ..... A61J 17/00
WO WO 99/11219 3/1999

OTHER PUBLICATIONS

Written Opinion of the International Searching Authority dated Mar. 22, 2010 in corresponding PCT application No. PCT/US2009/054125.

* cited by examiner

SECTION C-C

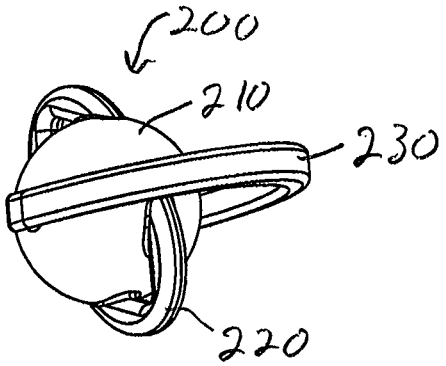
Figure 4A
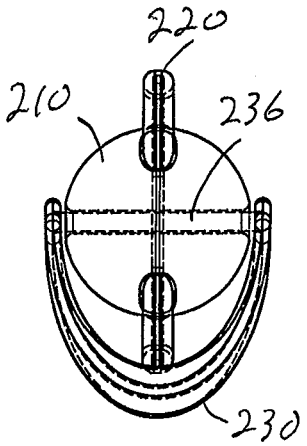
Figure 4B
Figure 4C
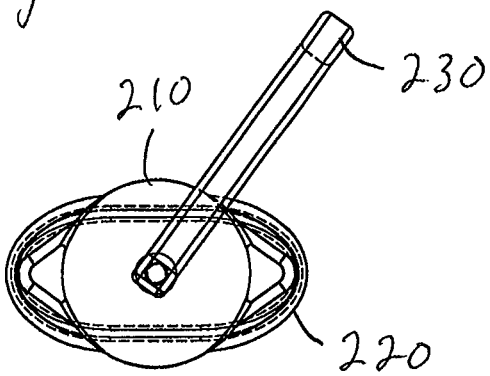
Figure 4D
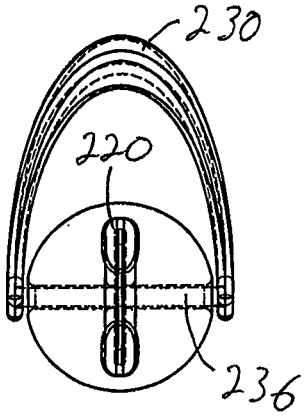

BIOLOGIC RESPONSE TEETHER

FIELD OF THE INVENTION

This invention relates to a teether.

BACKGROUND OF THE INVENTION

Infants have been observed for centuries biting on all types of objects during the period known as "teething". This has been interpreted as a way of "relieving" the pain presumed associated with the process. As teething typically occurs during infant ages 5 months to 24 months, the pressure areas may be the gum pads (alveolar ridges), the erupting or newly erupted teeth, or a combination of both teeth and gums. A "teether" is a device that is designed to be chewed on by an infant to address teething-related issues.

SUMMARY OF THE INVENTION

This invention features a biologic response teether. The inventive biologic-designed teether distorts in response to the biting pressure of the infant, and returns to the original shape. Areas of the teether conform to different requirements of bite force depending on teether position in relation to the gums and newly erupted teeth. "Suckling bite forces" in the neonate, infant and toddler are important, in that mechanical forces and condylar loading account for development of cartilage in the temporomandibular joint (TMJ) as well as the anatomic shape of the articular eminence. Further, bite forces against the alveolar ridge have led to complications with the development of the primary incisors, in the observation of hypoplastic defects due to excessive pressures (from laryngoscopes or oral intubations) against the alveolar ridge.

The inventive biologic-designed teether responds to these different conditions and remains fully controllable by the bite force generated by the infant, e.g., moderating bite force pressure results in moderating teether response. Greater bite force accomplishes more directed pressure on the biting surfaces of the mouth. Lower biting forces disperse the pressure. The infant can choose an appropriate teether location in the mouth, an appropriate location on the teether, an appropriate bite force, and an appropriate bite angle to accomplish a desired result, using feedback as necessary to vary the locations, bite force and bite angle.

The biologic distortion, which is a response to the infant bite force, can be accomplished at least in part by the use of a hard rigid polymer inner core of regular or varying thickness, and a second compressible lower durometer material, regular or varying in thickness, acting as a full or partial covering layer. In another embodiment that can accomplish similar results in terms of development of the TMJ, the lower durometer material is the core and the covering is the higher durometer material. In one embodiment the teether has two mouth-engageable ends and a center stabilizing shield. Either of the ends may also serve a dual function as a handle for the mother or infant's grasp.

Bite force in infants and children increases with age. The differences in bite force can be accommodated herein at least in part by design of the internal component of the teether (e.g., hollow core, catacomb (honeycombed or chambered) core, core and/or covering material (such as silicone, elastomeric, or urethane like material), core thickness). There is a relationship between bite force, muscle development and muscle mass.

The maximum velocity of TMJ eminence development occurs prior to 3 years of age. This anatomic structure of the jaw affects the functioning of the jaw. Between birth and 3 years the angle of growth will double. The angle of different embodiments of the inventive teether ridges can be designed to reflect this change. A significant part of this growth and change in the TMJ eminence angle occurs prior to the completion of the eruption of the second primary molars (age 24-36 months) and during the teething phase (6-36 months). The stages of designs of the inventive teether reflect this.

Corresponding to the increase in chewing efficiency (from birth to 3 years) a unilateral occlusal motion has evolved and masticatory cycles are shaped by sensory feedback. The inventive teether shape is designed to enhance this evolving development. The suckling motor pattern resembles that of mastication suggesting that the transition is gradual during postnatal development. The inventive teether changes among the different designs reflect this gradual transition. Muscle activity is different during chewing, nipple attachment (stretching) and rhythmic sucking. The inventive teether is designed to this progression. The development of the occlusion triggers the masticatory motor pattern. The inventive teether design aids in development of masticatory motor skills because it is designed to be used during the stages of tooth eruption.

The inventive teether can be embodied in various designs that in part capture these aspects of design that are most appropriate for the age or stage of development of the child, typically one that mimics feeding progression. Such development stages may include the following groups: Stage one—liquids (mostly sucking and oral positioning development). Stage two—soft solids (special relations and starting development of the grinding of food and swallow, early speech development). Stage three—solids (chew and focus on tempromandibular joint (TMJ) development and speech development).

For example, the various embodiments of the invention can include traditional teether shapes, or unique or non-traditional shapes. The width and thickness of biting surfaces vary according to tolerance at each developmental stage. The thickness of the portions of the teether that are designed to be bitten will typically change by the appropriate amount according to the age/stage of development of the child. Generally this incremental change in thickness is a 1-2 mm increase per stage, e.g., stage one may be 6-8 mm thick, stage two 8-11 mm thick, and stage three 11-13 mm thick.

The teether mimics the necessity for directed and disbursed forces which provide the mechanical load for proper TMJ, oral facial muscle development, support and stabilize the mandibular arch and support normal oral myofunction. The teether was developed with the proper ridge and valley angles consistent with jaw function and growth. Different stages allow for the different "squeeze loads" ideally suited for the proper forces needed to enhance TMJ/jaw development. The teether responds to the infant's bite; it distributes the forces as the infant determines and the infant applies the just right biting force. All stages of the teether allow the infant to produce different "squeeze loads" providing the sensory feedback for pain relief. The teether is designed to encourage the proper functional stimulation that will support articulatory speech development. The shield is designed to support and position the teether and enhances the development of the important "lip seal" function.

One embodiment of the invention includes a biologic response teether comprising a shield, and a generally "T"-shaped bite portion projecting from the shield and comprising a relatively hard inner core at least partially covered by a softer outer layer. The inner core defines an elongated stem closest to the shield, and two arms that are transverse to the stem. The stem may define at least one protuberance (typically at about the stem midpoint), and each arm preferably defines at least one protuberance. The outer layer may have a constant or a variable thickness. Each arm may define a protuberance near the two distal ends of the arm (farthest from the stem). The inner core may be generally flat, and of uniform thickness, and the protuberances may be in the outer layer. The stem may be curved or straight along its length. The arms may or may not have the same length. The arms may lie along a curve that approximates the curve of the dental arch so that the infant can bite on the arms at the locations of both the incisors and the molars (either before or after eruption). The distance from the end of one arm to the closest location on the shield may differ from the distance from the end of the other arm to the closest location on the shield, to allow different positioning of the ends of the arms in the mouth with the shield outside of the mouth, typically against the lips. A double-ended version includes two such "T"-shaped portions, which may or may not be the same shape. One such portion typically presents a different hardness than the other so that the infant has a hardness choice in a single teether.

Another embodiment of the invention includes a hub member, a ring member coupled to the hub member, a plurality of generally planar teething members mounted to the ring via a through-hole between the two faces of the teething members so as to movable relative to the ring. At least one teething member defines a plurality of elongated ridges and valleys, the ridges at angles of from about 5 degrees to about 40 degrees from the face of the at least one teething member, and at least one other teething member defining a generally flat surface interrupted by a series of through holes. Each teething member may define a different thickness than the other teething members.

Yet another embodiment features a biologic response teether comprising a shield, an annular first teething member projecting from one side of the shield, and an arch-shaped second teething member projecting from the other side of the shield and defining a pair of curved arms projecting away from the shield. Each arm of the second teething member may define generally flat upper and lower surfaces with a depression in each surface proximate the ends of each of the arms. The first teething member may define generally flat upper and lower surfaces with a ridge in each surface proximate the location furthest from the shield. The first and second teething members may each comprise a relatively soft inner core at least partially covered by a harder outer layer.

BRIEF DESCRIPTION OF THE DRAWINGS

Other objects, features and advantages will occur to those skilled in the art from the following description of preferred embodiments and the accompanying drawings, in which:

FIGS. 4A-4D are perspective, top, side and end views, respectively, of a fourth embodiment of the biologic response teether of the invention.

DESCRIPTION OF PREFERRED EMBODIMENTS

Figure 1A:
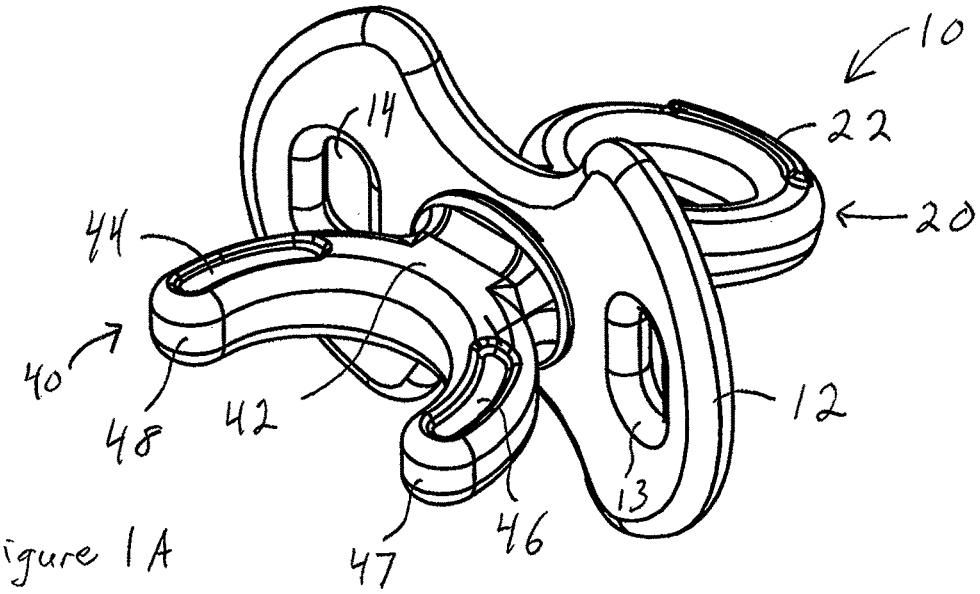
FIGS. 1A-1D are perspective, front, cross-sectional and side views, respectively, of a first embodiment of the biologic response teether of the invention.
Figure 1B:
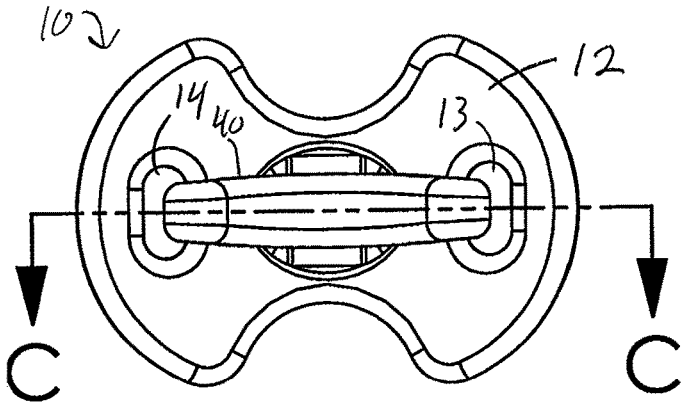
Figure 1C:
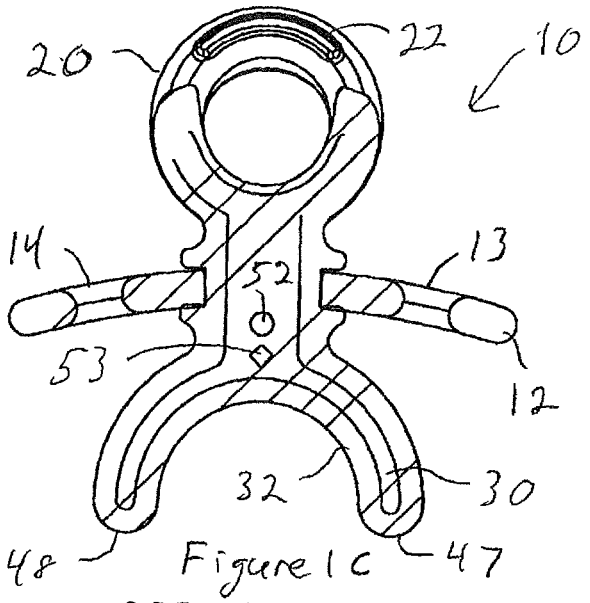
Figure 1D:
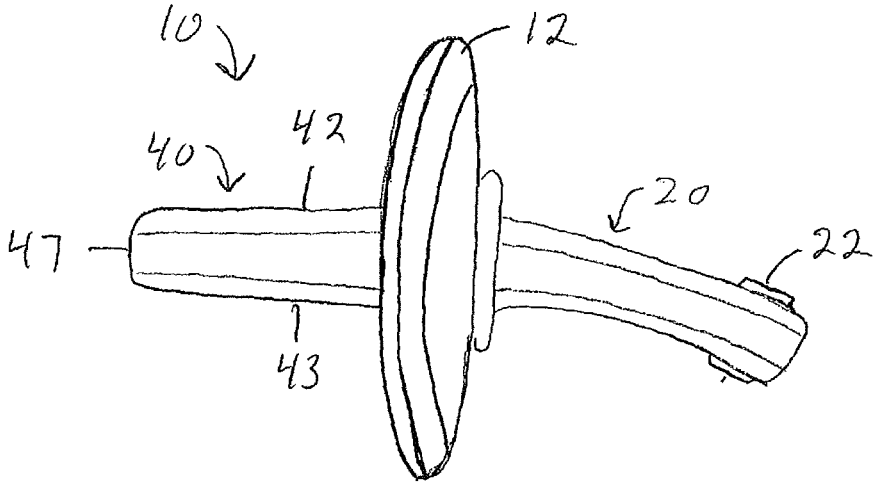

The embodiment 10 shown in FIG. 1 is a first stage teether that is intended to be used for 0-4 month range infant. Notice the small 1-2 mm wide indent pattern 44, 46 that is at the posterior part of the arch 40 proximate distal (posterior) ends 47 and 48. These are used for alignment of the gums on the bite surface and/or application of teething gel or another anesthetic of similar nature. Their depth does not to exceed 1 mm: this prevents the chance of pulling out a tooth. General dimensions would fit the following: width of the two arms of arch 40, 6-9 mm, arch diameter (to midpoints of ends 47 and 48) 29-32 mm, depth of appliance into mouth would not exceed 30 mm, but generally around 25-30 mm depth (outside of lips or inside of shield 12 being the reference point). These dimensions are selected so that the arch will essentially match the alveolar ridge or gum ridge of the infant, and so will vary depending on the stage of the design.

The annular ring feature 20 is a circle of at least 14 mm inner diameter and width around 6 mm, but could also be an ellipse ranging from minor axis (arranged in the anterior/posterior direction) of 14 mm-20 mm and major axis of 25-40 mm allowing the lips to "seal" or surround the feature. Sealing is important for developing speech.

Embodiment 10 may have a soft inner core 30 (hardness of Shore 25-35 A) with a harder outer cover 32 (hardness 50-60 A). The very slight grooves 44, 46 toward ends 48 and 47 of bite surfaces on the u-shaped feature is for alignment of gums as well as place to hold teething gel. Ring-side 20 has ridge 22 for additional contrasting bite surface. The hard shield (solid) 12 is designed with curvature for facial alignment while allowing for open airy feel on child's face, in part accomplished with openings 13 and 14. The grooves (46, 44) and ridges (22) are preferably on both the upper 42 and lower 43 surfaces of teether 10. Features such as different shape through-holes 52 and 53 in core 30 will fill with overmolded material to assist in a tight bond between the core and the overmolded outer layer.

FIG. 2 shows another embodiment 80 that can be designed to accommodate all three stages. This embodiment looks and to some extent acts like a ring of keys. The different teething members define slopes with angles ranging from 5-25 degrees slope for ages 0-4 months, 15-35 degrees for 4-9 months and 20-40 degrees for 9 month plus. Depth of ridges should not exceed 2 mm, but may range from 0.5 mm to 2 mm depending on the age range and feature. Peaks may be as high as 3 mm, but will have gradual angles to plateaus or extended flat sections such as on the surface of member 90.

Figure 2A:
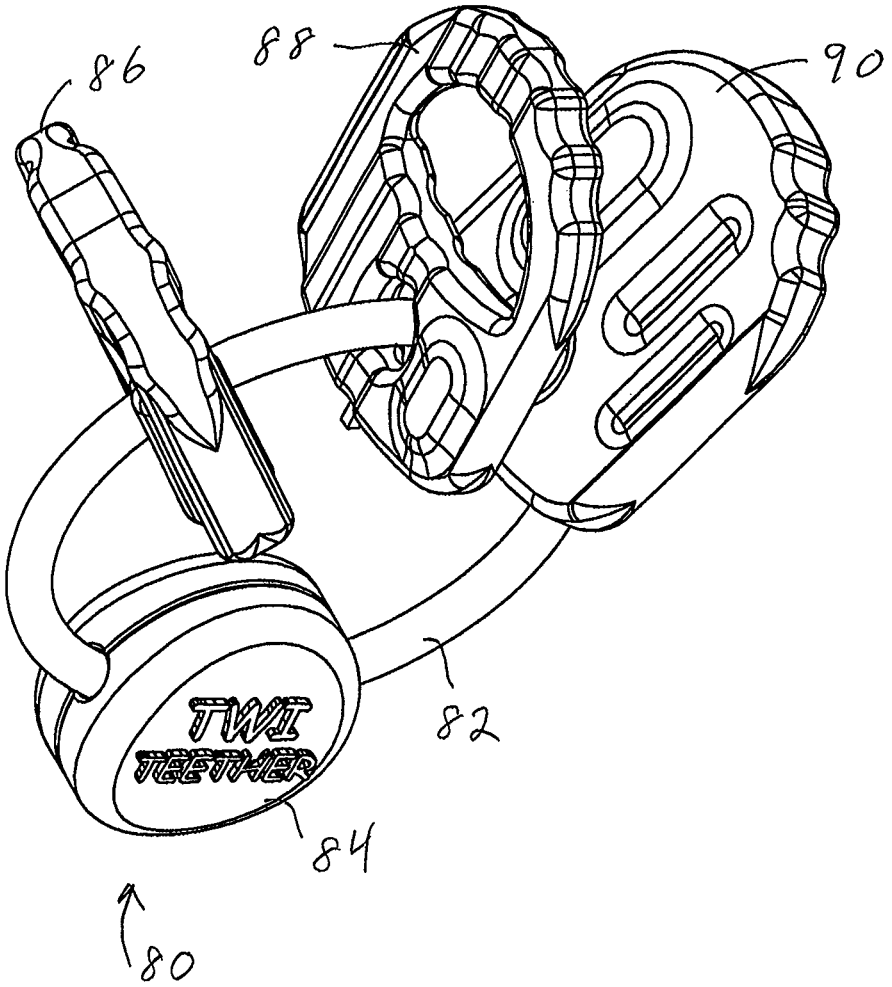
FIGS. 2A-2D are perspective, front, top and partial cross-sectional views, respectively, of a second embodiment of the biologic response teether of the invention.
Figure 2B:
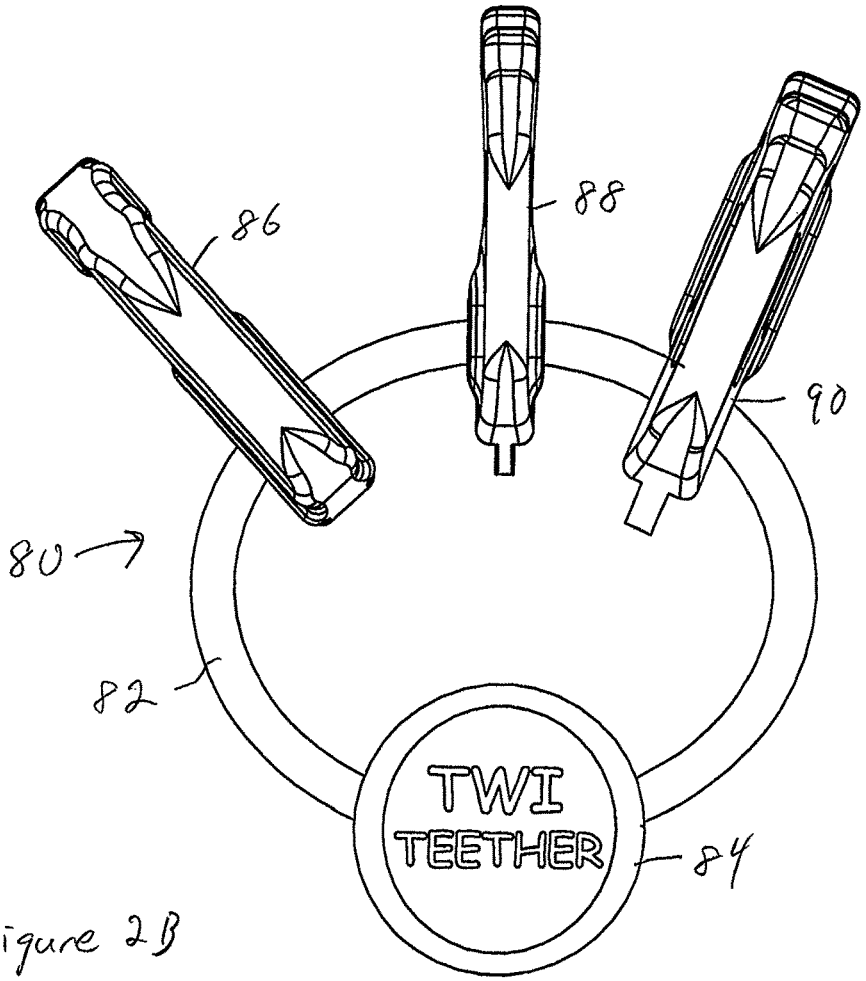
Figure 2C:
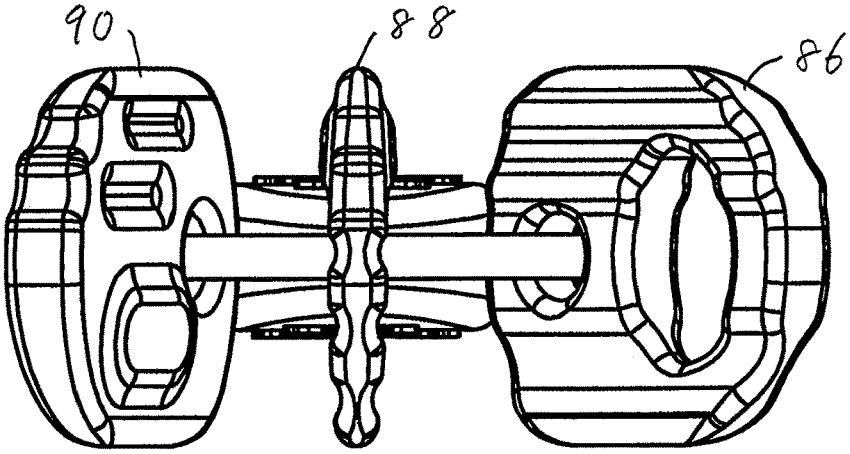
Figure 2D:
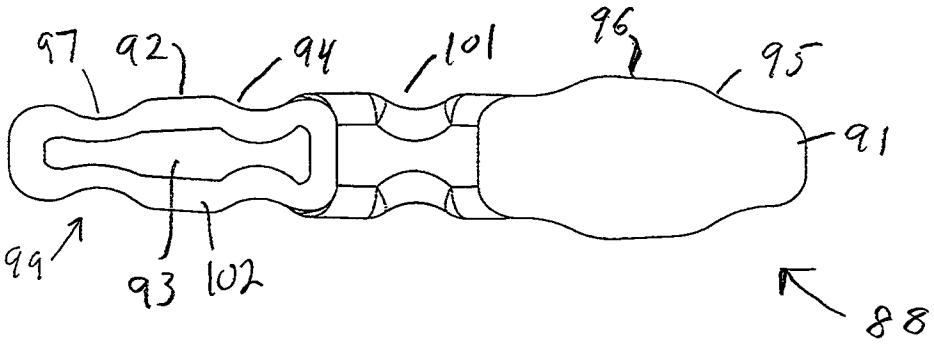

These "keys" 86, 88 and 90 are movable along ring 82 and include valleys angled to develop TMJ growth for the three stages, raised ridges, larger raised "plateau" surfaces, and multi-thickness designs (see the three different thicknesses in the side view of FIG. 2C) for developing bite forces, and large open areas to develop lip seal for speech and food development. The teething members 86, 88 and 90 can include any or all combination of the following: Hard inner core (80 A) with softer outer surface (50-60 A); all hard (80 A); all softer (50-60 A); or super soft (25-35 A) with harder outer surface (50-60 A). The multi-part teether design also works to develop hand eye coordination. The connector or hub 84 for ring 82 is a large multi-textured surface to act as a solid for grasp development and or teething surface. The cross-section of member 88, FIG. 2D, illustrates several features of one or all of the movable members. End 91 has thick plateau 96 and slope 95 leading to a thinner end region. The different thicknesses provide that ability to bite with the mouth open different amounts, to accomplish different forces. The same is true generally of second end 99, with thicker portion 92, thinner portion 97 and slope 94. Additional slopes are provided in opening 101. This embodiment also illustrates end 99 with core 93 and overlay 102, while end 91 is of a single material. The "key" members thus can present any of the various teether design options disclosed herein.

FIG. 3 shows third embodiment of teether 150, with shield 160 and projecting generally "T"-shaped bite or teething portions 170 and 180. Each such portion has a stem (171, 181) that is coupled to the shield, and a cross-member (169, 168) coupled to each stem. Typically the cross-member comprises two short arms that are located at the end of the stem. Typical dimensions include the following: depth into mouth not to exceed 30 mm, but generally 28 mm maximum depth (from the inside of the shield to the farthest portion of member 170 or 180 (see dimensions and curvature radii illustrated in FIG. 3B)). The distal or posterior ends of the "T"-shaped projections 170 and 180 include cross-members 169 and 168 respectively that are, in essence, curved ends 172, 174, 182, 184 that range from 12 mm diameter to 16 mm (12.7 mm in this example). The distal ends also include an outer (at the most posterior location) curvature or arch (such as curve 187, FIG. 3B) to follow the dental arch, with a radius of 15-20 mm (18.501 mm in this example) depending on the age range targeted. The overall width of cross-members 169 and 168 (almost equivalent to the length of the infant's dental arch) is 30-40 mm (36.7 mm in this example). Peaks and valleys (e.g., shown in FIG. 3C) have radii of approx 4-5 mm (4.49 mm in this example), and angles that range from 15-40 degrees (39.25 degrees in the example, as the depicted embodiment is for a 4-9 month old child). In the example, the cross-members 168 of portion 180 define three bulbous portions 184, 186 and 182 with valleys 185 and 189 therebetween. The angle defined by surface 201 is about 39.25 degrees. All of these shapes, curves, sizes and angles are variable following the parameters set forth herein to accomplish the results set forth herein.

One portion 180 may be made only from harder 80 A material 190, with ridge and valley features that meet proper angles for that stage of development. In this case the opposing portion 170 has a core of material 190 with an overmolded layer 192 which is a softer 50-60 A material. Portion 170 defines an enlarged raised plateau 176, and the sidewalls of the plateau form angled surfaces as well. Layer 192 can be either a smooth surface over a properly ridged core 190, or a ridged pattern over a smooth core 190. The shape of cross-members 169 and 168 are designed to correspond to the arch of the gum-line, allowing the child to safely access anterior and posterior teeth with different bite forces and sensations at the same time, which can both develop the TMJ and alleviate pain at the same time. The shape is illustrated by outer arch curve 131 and arch bisecting curve 132, FIG. 3E. These curves are established such that the transverse posterior ends of "T"s 170 and 180 will lie along the gum ridge, so that the child can bite with the entire area from the incisors to the molars should such be desirable to the child.

Figure 3A:
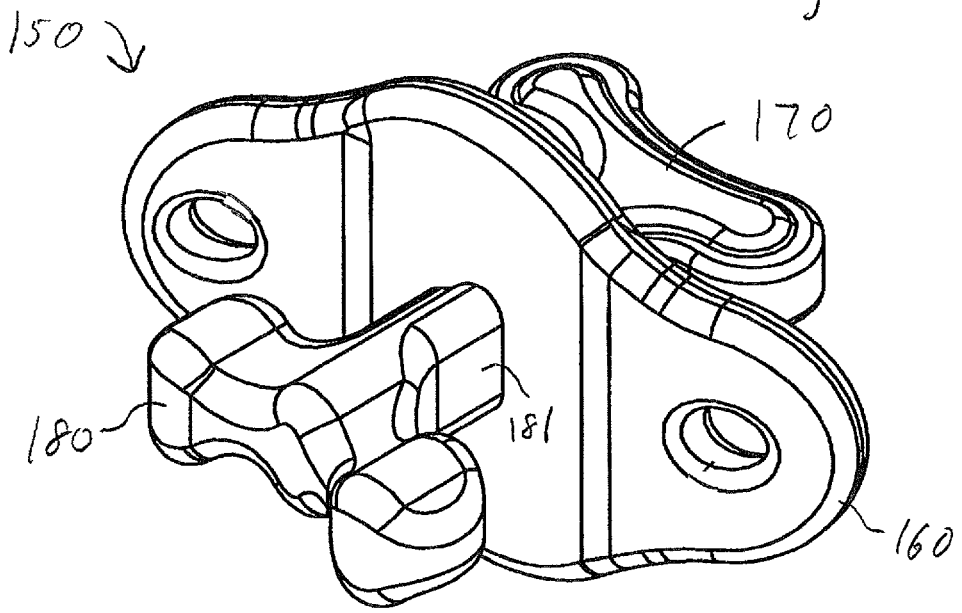
FIGS. 3A-3G are perspective, top, front, side, full cross-sectional and two partial cross-sectional views, respectively, of a third embodiment of the biologic response teether of the invention.
Figure 3B:
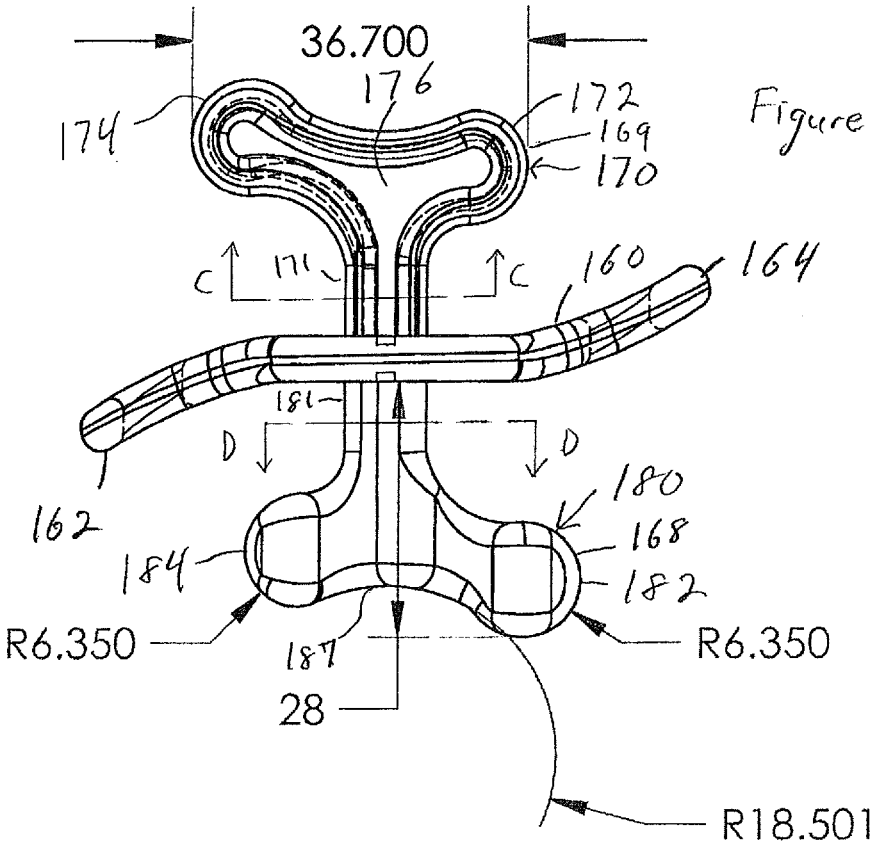
Figure 3C:
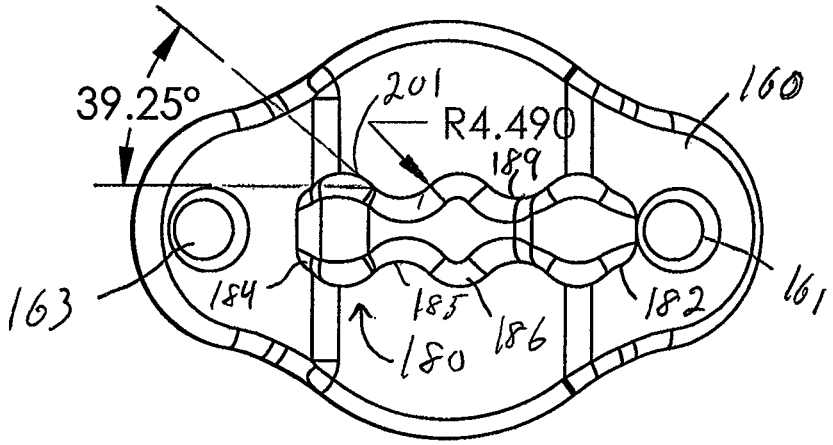
Figure 3D:
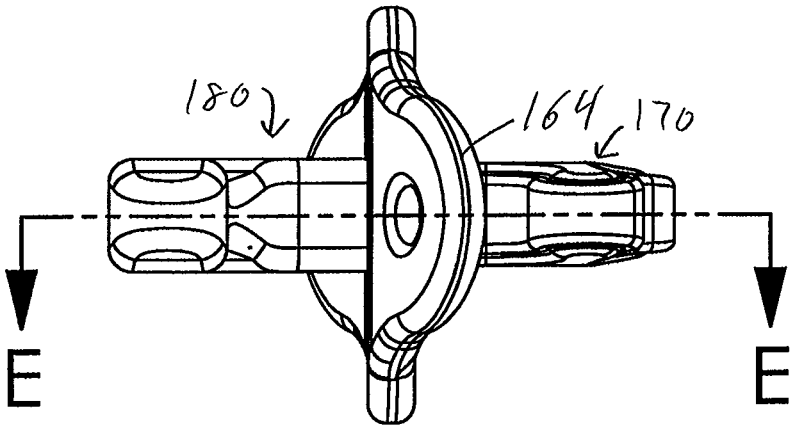
Figure 3E:
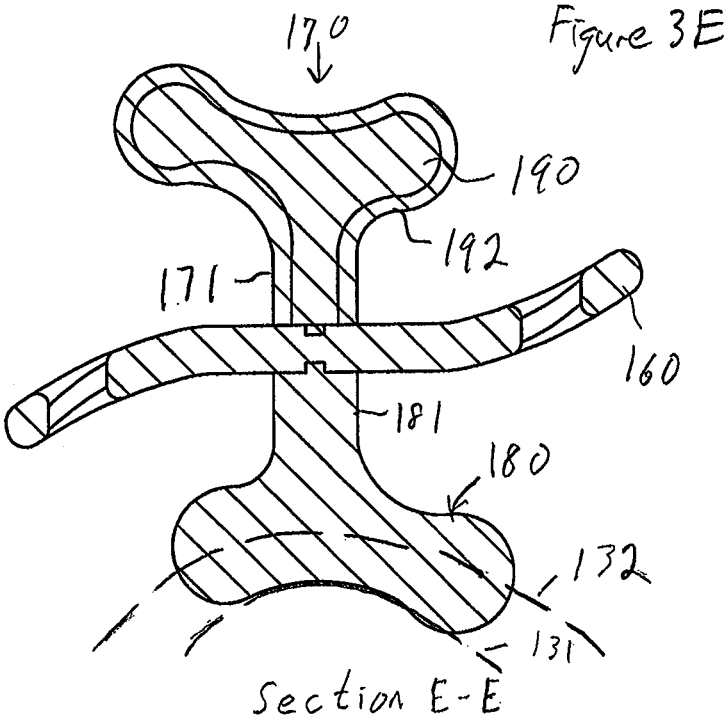
Figure 3F:
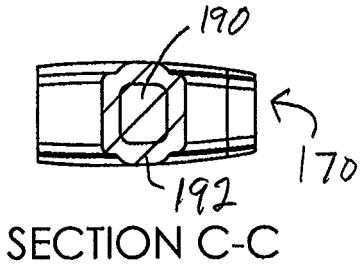
Figure 3G:
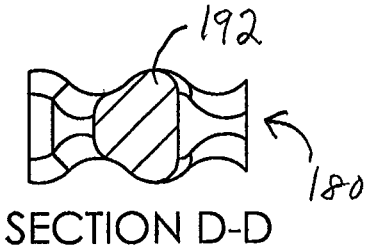

The material of the core 190 can be a high durometer thermoplastic, PEBAX, urethane or silicone with a hardness of approximately 70 D or above, while the outer layer may be overmolded on the inner core and comprise a lower durometer theramoplastic, PEBAX, urethane or silicone with a hardness of approximately 40 D or lower; other hardnesses are set forth above. The outer layer can be contoured with peaks and valleys. This allows for the dissipative force of the bite or a soothing "gumming" effect, depending on how the child feels and how teether 150 is positioned in the mouth. The overall shape of the cross-members that define the transverse portions of portions 170 and 180 are such as to allow them to fit along the contour of the gum ridge. Also, as can be seen in FIG. 3B the inverse curvature of shield 160, with ends 162 and 164 that each curve toward one cross-member 169 or 168, along with the curves of cross-members 169 and 168, create variable distances from the shield to the two ends (172, 174, 182, 184) of each of cross-members 169 and 168. This construction allows the child to manipulate the teether to reach both anterior and posterior gums and teeth with both hard and soft areas of the teether, to provide maximum flexibility in the use of the teether. The shield is designed to allow the "T"-shaped "teether" portion to enter the mouth, but also prevent over insertion (shield contours allow this).

The core is preferably flat, with essentially uniform thickness. However, in alternative embodiments not shown in the drawings, the core may have peaks and valleys. If the core has peaks and valleys, the outer layer is preferably of relatively uniform thickness, but need not be.

Fourth embodiment 200, FIG. 4, comprises a unique shape teether with rotating sphere 210 with ring features including an inner ring 220 that could be either hard (80 A) or soft (25-35 A) material for alternative bite feels. The main body of the sphere 210 is ideally 50-60 A. Sphere 210 rotates on axle 236 to develop hand eye coordination. Outer ring feature 230 is 80 A for support and safety. Also adds lip-seal feature.

In all overmolded designs, a minimum of 1.25 mm of overmolded material should be used. This is for safety reasons. A dimension of less than 1.25 mm and any material softer than a 50-60 A silicone could lead to a safety hazard: the child could bite through.

The child can use natural feedback mechanisms (sensory comfort areas), such as relief from pain, to properly position the teether in the mouth in order to locate a desired surface of the teether against a desired area of the teeth and gums.

In other embodiments the inventive teether may be shaped more conventionally, for example as a teething ring, while still incorporating the inner core, outer covering and peaks and valleys, to respond to varying bite forces. Certain embodiments may be shaped to match the gum ridge completely, or a single rod to mimic a finger. In the case of a single rod, the peaks and valleys represent the hard knuckles and softer skin areas of a finger.

While the foregoing invention has been described in some detail for purposes of clarity and understanding, particular embodiments are to be considered as illustrative and not restrictive. It will be appreciated by one skilled in the art from a reading of this disclosure that certain changes in form or detail may be made without departing from the scope of the invention and are within the scope of the following claims. For example, features shown in some drawings and not others may be combined in different manners in accordance with the invention.

What is claimed is:

1. A biologic response teether, comprising:

a generally oval shaped shield with a major axis, a minor axis, two opposing sides, a top and a bottom that lie on the minor axis, and first and second lateral shield ends that lie in a plane with the major axis; and a first bite portion projecting from one side of the shield and comprising an elongated first stern coupled to the shield, the first stem having a distal end spaced farthest from the shield, and a first cross-member coupled to the distal end of the first stem and transverse to the first stem, the first cross-member comprising two first cross-member ends, wherein the first stem has two opposing sides and the first cross-member ends are on opposite sides of the first stem;

wherein the two first cross-member ends lie along a curve that is adapted to follow a dental arch of a child, and wherein one of the two first cross-member ends is closer to the shield than is the other first cross-member end, such that the two first cross-member ends are adapted to lie along a gum ridge of the child;

wherein a cross-sectional plane through the two first cross-member ends and the first stem is co-planar with the shield major axis;

wherein the shield is curved along the shield major axis, with the first lateral shield end curved toward the first bite portion and the second lateral shield end curved away from the first bite portion, such that the first lateral shield end is closer to the first bite portion than is the second lateral shield end, to allow the child to manipulate the teether to reach both anterior and posterior gums and teeth.

2. The biologic response teether of claim 1 further comprising a second bite portion projecting from the opposing side of the shield from the first bite portion and comprising an elongated second stem coupled to the shield, where the second stem has a distal end spaced farthest from the shield, and a second cross-member coupled to the distal end of the second stem and transverse to the second stem, the second cross-member comprising two second cross-member ends, wherein the second stem has two opposing sides and the second cross-member ends are on opposite sides of the second stem, wherein the two second cross-member ends lie along a curve that is adapted to follow a dental arch of a child, and wherein one of the two second cross-member ends is closer to the shield than is the other second cross-member end, so that the two second cross-member ends are adapted to lie along a gum ridge of the child.

3. The biological response teether of claim 2 wherein the first cross-member ends are not the same length as one another, and wherein the second cross-member ends are not the same length as one another.

4. The biological response teether of claim 3 wherein the shorter cross-member ends are closer to the shield than the longer cross-member ends.

5. The biological response teether of claim 2 wherein the first bite portion defines three spaced bulbous portions separated by two valleys, where a first bulbous portion makes up most of one first cross-member end and a second bulbous portion makes up most of the other first cross-member end.

6. The biological response teether of claim 5 wherein the bulbous portions and valleys form a series of peaks and valleys that have radii of curvature of approximately 4-5 mm and angles that range from 15-40 degrees.

7. The biological response teether of claim 2 wherein the second cross-member has a generally flat face and defines a plateau that covers most of the face, wherein the plateau comprises a raised flat surface and angled sidewalls that connect the raised flat surface to the generally flat face.

8. The biological response teether of claim 2 wherein the first bite portion is made from a single relatively hard material, and wherein the second bite portion is made from a relatively hard inner core at least partially covered by a softer outer layer.

9. The biologic response teether of claim 1 wherein the first bite portion defines generally flat upper and lower surfaces with a ridge in each surface.

10. The biological response teether of claim 1 wherein the first bite portion comprises a relatively soft inner core at least partially covered by a harder outer layer.

11. The biological response teether of claim 1, wherein the first cross-member has a curved distal end that is adapted to follow the dental arch of the child.

12. The biological response teether of claim 11, wherein the curved distal end of the first cross-member has a radius of curvature of 15-20 mm.

13. The biological response teether of claim 1, wherein the shield comprises a planar central section with a flat surface from which the first bite portion projects.

14. The biological response teether of claim 13, wherein the first lateral shield end has a length from the planar central section to a distal end of the first lateral shield end, wherein the entire length of the first lateral shield end is angled away from the planar central section.

15. The biological response teether of claim 14, wherein the second lateral shield end has a length from the planar central section to a distal end of the second lateral shield end, wherein the entire length of the second lateral shield end is angled away from the planar central section.

16. The biological response teether of claim 15, wherein the flat surface of the planar central section of the shield extends along the shield minor axis in two opposed directions, one to the top of the shield and the other to the bottom of the shield.

17. A biologic response teether, comprising:

a generally oval shaped shield with a major axis, a minor axis, two opposing sides, a top and a bottom that lie on the minor axis, and first and second lateral shield ends that lie in a plane with the major axis;

a first bite portion projecting from one side of the shield and comprising an elongated first stem coupled to the shield, the first stem having a distal end spaced farthest from the shield, and a first cross-member coupled to the distal end of the first stem and transverse to the first stem, the first cross-member comprising first and second, first cross-member ends, wherein the first stem has two opposing sides and the first and second, first cross-member ends are on opposite sides of the first stem, wherein the first and second, first cross-member ends lie along a curve that is adapted to follow a dental arch of a child, and wherein the first, first cross-member end is closer to the shield than is the second, first cross-member end, such that the first and second, first cross-member ends are adapted to lie along a gum ridge of the child; and a second bite portion projecting from the opposing side of the shield from the first bite portion and comprising an elongated second stem coupled to the shield, the second stem having a distal end spaced farthest from the shield, and a second cross-member coupled to the distal end of the second stem and transverse to the second stem, the second cross-member comprising first and second, second cross-member ends, wherein the second stem has two opposing sides and the first and second, second cross-member ends are on opposite sides of the second stem, wherein the first and second, second cross-member ends lie along a curve that is adapted to follow a dental arch of a child, and wherein the first, second cross-member end is closer to the shield than is the second, second cross-member end, such that the first and second, second cross-member ends are adapted to lie along a gum ridge of the child;

wherein a cross-sectional plane through the first and second, first cross-member ends and the first stem is co-planar with the shield major axis;

wherein a cross-sectional plane through the first and second, second cross-member ends and the second stem is co-planar with the shield major axis;

wherein the shield is curved along the shield major axis, with the first lateral shield end curved toward the first bite portion and away from the second bite portion, and the second lateral shield end curved away from the first bite portion and toward the second bite portion, such that the first lateral shield end is closer to the first bite portion than is the second lateral shield end and the second lateral shield end is closer to the second bite portion than is the first lateral shield end, to allow the child to manipulate the teether such that the first and second bite portions are adapted to reach anterior and posterior gums and teeth;

wherein the first, first cross-member end is shorter along the shield major axis than is the second, first cross-member end, and wherein the first, second cross-member end is shorter along the shield major axis than is the second, second cross-member end;

wherein the first cross-member ends of both the first and second cross-members are closer to the shield than are the second cross-member ends of both the first and second cross-members;

wherein the first bite portion defines three spaced bulbous portions separated by two valleys, where a first bulbous portion makes up most of one first cross-member end and a second bulbous portion makes up most of the other first cross-member end;

wherein the bulbous portions and valleys form a series of peaks and valleys that have radii of curvature of approximately 4-5 mm and angles that range from 15-40 degrees;

wherein the second cross-member has a generally flat face and defines a plateau that covers most of the face, wherein the plateau comprises a raised flat surface and angled sidewalls that connect the raised flat surface to the generally flat face; and wherein the first bite portion is made from a single relatively hard material, and wherein the second bite portion is made from a relatively hard inner core at least partially covered by a softer outer layer.

18. The biological response teether of claim 17, wherein the first, first cross-member end is closer to the first lateral shield end than is the second, first cross-member end, and wherein the first, second cross-member end is closer to the second lateral shield end than is the second, second cross-member end.

19. A biologic response teether, comprising:

a generally oval shaped shield with a major axis, a minor axis, two opposing sides, a top and a bottom that lie on the minor axis, and first and second lateral shield ends that lie in a plane with the major axis; and a first bite portion projecting from one side of the shield and comprising an elongated first stem coupled to the shield, the first stem having a distal end spaced farthest from the shield, and a first cross-member coupled to the distal end of the first stem and transverse to the first stem, the first cross-member comprising two first cross-member ends, wherein the first stem has two opposing sides and the first cross-member ends are on opposite sides of the first stem;

wherein the shield is curved along the shield major axis, with the first lateral shield end curved toward the first bite portion and the second lateral shield end curved away from the first bite portion, such that the first lateral shield end is closer to the first bite portion than is the second lateral shield end, to allow the child to manipulate the teether to reach anterior and posterior gums and teeth;

wherein the shield comprises a planar central section with a flat surface from which the first bite portion projects, wherein the first lateral shield end has a length from the planar central section to a distal end of the first lateral shield end, wherein the entire length of the first lateral shield end is angled away from the planar central section, and wherein the second lateral shield end has a length from the planar central section to a distal end of the second lateral shield end, wherein the entire length of the second lateral shield end is angled away from the planar central section.

* * * * *